United States Patent [19]

Pecker et al.

[11] 4,166,995

[45] Sep. 4, 1979

[54] THERMOSTATIC SNAP SWITCH

[75] Inventors: Guillermo E. Pecker, Elizabeth; Douglas J. Slack, Smithfield Plains, both of Australia

[73] Assignee: Texas Instruments Incorporated, Dallas, Tex.

[21] Appl. No.: 851,024

[22] Filed: Nov. 14, 1977

[51] Int. Cl.[2] ..... H01H 37/46; H01H 37/60

[52] U.S. Cl. ..... 337/390; 337/131; 337/382

[58] Field of Search ..... 337/390, 382, 383, 384, 337/385, 386, 387, 388, 389, 391, 392, 393, 394, 395, 396, 131

[56] References Cited

U.S. PATENT DOCUMENTS

| | | | |
|---|---|---|---|
| 2,793,270 | 5/1957 | Burch et al. | 337/394 |
| 3,213,244 | 10/1965 | McCarrick | 337/386 |
| 3,339,044 | 8/1967 | Ruckriegel et al. | 337/347 |

*Primary Examiner*—Harold Broome

*Attorney, Agent, or Firm*—John A. Haug; James P. McAndrews

[57] ABSTRACT

This invention relates to a thermostatic snap switch and in particular it relates to a switch of the type which has a temperature sensing probe containing an actuating element for the switch.

5 Claims, 5 Drawing Figures

THERMOSTATIC SNAP SWITCH

BACKGROUND OF THE INVENTION

Thermostatic snap switches of the temperature actuated type are used in electric frypans and similar devices and usually comprise a housing having a projecting probe as well as contact members so that the unit can be plugged into a frypan or the like and will then control the temperature by switch actuation.

Devices of this general type have a disadvantage in that they tend to cause electrical noises in equipment such as radios or television, this being due to the relatively slow movement of a thermostatic control member such as a bimetallic strip and causing some amount of arcing during the action of switching, and also the switching will cause pitting and damage to the contacts when directly achieved by the bimetallic strip.

For this purpose it has been proposed in an earlier invention of ours, the subject of Australian patent application No. 84063/75, (PB8571/74) dated Aug. 19, 1974 to use a magnetic switching device under influence of the thermostatic switching member to achieve an overbalance when a particular condition exits to give rapid opening or closing of the contacts of the switch.

Such a device has been found to be particularly effective in that it is sensitive to pressure by the bimetallic strip to load the switching member to a point where a snap action is achieved due to the influence of the magnetic holding device.

The present invention again uses a snap action device as its switch, but instead of using a magnetic control member, control in this case is by a tensioned switch blade which overbalances to either the open or the closed position of the contacts when appropriate pressure is applied to a support blade which carries the switch blade.

The invention comprises a temperature sensitive member mounted to contact and deflect a support blade for a snap action over balancing switch blade which carries a movable contact in engageable relationship with a fixed contact, the overbalancing point of the switch blade being adjustable by engaging a tensioning member on the switch blade on a tongue which is adjustable in position within and/or through the plane of movement of the switch blade.

In order however to enable the invention to be fully appreciated an embodiment will now be described with reference to the accompanying drawings, but it is to be clear that the invention is not to be limited to the details disclosed hereinafter, the scope being defined in the claims.

IN THE DRAWINGS

Figure 1:
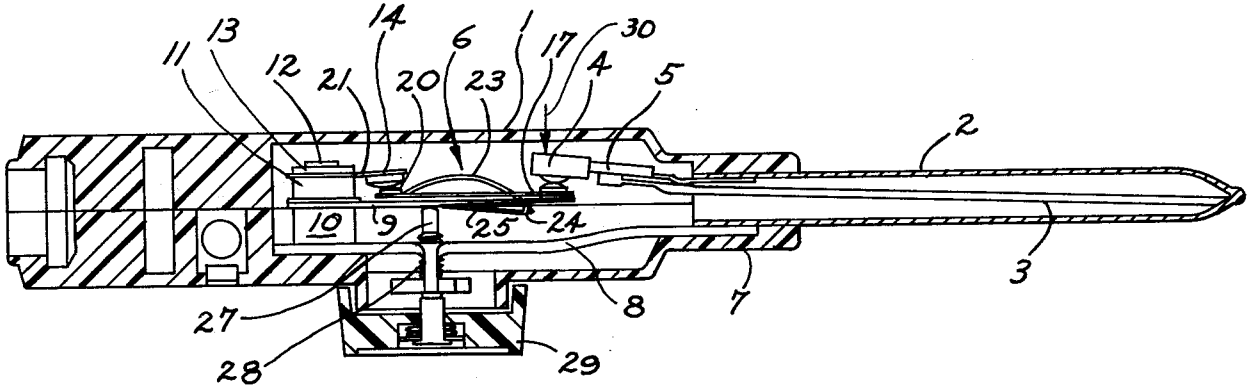
FIG. 1 is a longitudinal section of the case, probe and control knob, showing a thermostat switch embodied therein.

A two piece frame 1 of plastic or other material has projecting from it a probe 2 which contains in it a rod 3 of a different expansion coefficient than the probe. The rod is fixed at one end to the probe and at its opposite end engages the member 5 on the probe so that temperature responsive movement of the rod relative to the probe deflects the pressure head 4 to transmit such movement to the overbalancing switch mechanism. The probe 1 and rod 3 are thus arranged to form a temperature sensing member for operating overbalancing switch 6 at a selected device temperature.

Within the housing 1 is a frame 8 which extends from the probe 2 and supports the switch mechanism 6. The frame 8 supports a metal blade 9, which we will term the support blade, which forms one member of the overbalancing switch assembly 6, the frame 8 supporting the support blade 9 through insulators 10 and 11 held to the frame 8 by a pin 12. Insulated from the pin 12 by an insulator 13 but held thereby, is a fixed contact 14. The blade 9 has a central tongue 25 which is joined to the blade at one end of the tongue but which is otherwise separated from the blade, the opposite end of the tongue being turned up to form a reaction front 24.

Securely mounted on the support blade 9 at its free end of blade 9 is a switch blade 17 which projects back from the free end of the support blade 9 towards the support pin 12 of the frame 8. This switch blade 17 has on its free end a contact 20. The contact 20 is thus in electrical continuity with the support blade 9 through the switch blade 17 and electrical connections can be made to the support blade 9 and to the blade 21 on which the contact 14 is mounted.

Figure 3:
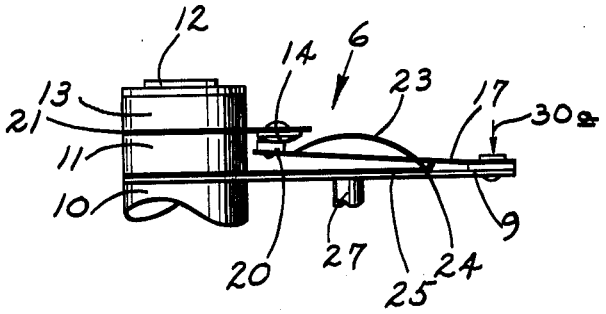
FIG. 3 is an enlarged side elevation of the snap action switch mechanism with the points in a closed position.
Figure 4:
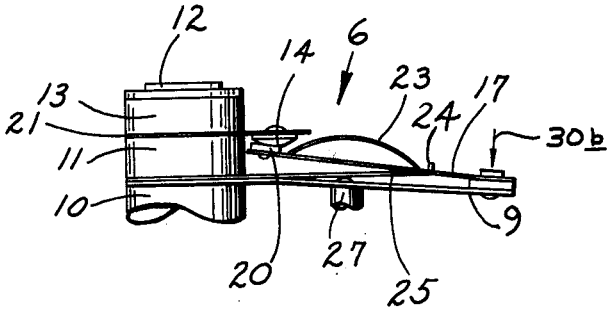
FIG. 4 shows the mechanism being distorted by pressure such as from a temperature sensing rod.
Figure 5:
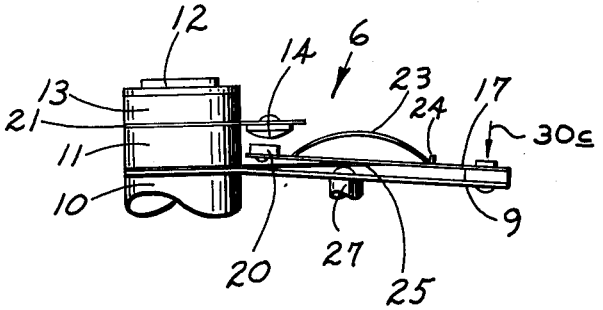
FIG. 5 shows the mechanism overbalanced to open the contacts, a slightly different form being shown in FIGS. 3, 4 and 5 partly for clarity of description.

The switch blade 17 is of the type which has a loading section 23 which is joined at one end to the blade 17 but which is otherwise punched out and separated from the blade 17 in the nature of a spring to be tensioned against the reaction point 24 on the tongue 25 on the support blade 9. The shaping of the blades 9 and 17 is such that the reaction point 24 is normally in approximately the plane of the switch blade 17 when no substantial force is applied at **30*a* on the ends of the blades 9 and 17 and when the control member 27 is in the position as shown in FIG. 3. However the shaping is such that by adjustment of the control member 27 as noted below for moving the reaction point 24 out of the plane of the switch blade 17 to either side of the plane of the blade 17, the tension on this member rapidly deflects the switch blade to either open or close the pair of contacts 14 and 20. That is, as is described below, the control 27 is adapted to be adjusted so that, when the pressure member 4 deflcts and applies a selected force 30*b* on the ends of the blades 9 and 17 at a first device temperature, the reaction point 24 is located at one side of the plane of blade 17 as shown in FIG. 4. In that setting of the control 27, the force of the blade 17 is applied in a direction for pulling the spring 23 against the reaction point 24 and for holding the contact 20 engaged with the contact 14 to close a circuit. However, when relative movement of the rod 3 and probe 2 occurs in response to temperature change and deflects pressure member 4 to apply a greater force 30*c* on the ends of the blades 9 and 17, the blade ends are adapted to move--initially for holding the contacts engaged with greater force. Then, when sufficient temperature shift occurs and the ends of the blades 9 and 17 are moved sufficiently so that the reaction part 24 passes through the plane of blade 17 and is disposed at the opposite side of the plane of the blade 17 as shown in FIG. 5, the force of the blade 17 is applied in a different direction for moving the contact 20 with snap action out of engagement with the contact 14 to open the noted circuit. As noted above, one contact 20 is on the switch blade 17, the other contact being on the member 21 which is insulated from the support blade 9 but is supported by the pin 12 and the insulators 10 and 11**.

That is, by adjusting the position of the reaction point 24 in relation to the switch blade, it is possible to select the overbalancing temperature at which the switch blade will operate. This is achieved by a control member 27 which is supported by the frame 8 but is longitudinally adjustable by a screw thread 28 engaged in a threaded aperture in the frame 8 and operated by a knob 29 carried on the control member 27. The portion of the support blade 9 which is adjusted is the tongue 25 which projects outwardly from the pin 12 and from the insulator support 10–11 of the switch blade 9. That is, the reaction point 24 can be moved up and down by simply loading this tongue 25.

Figure 2:
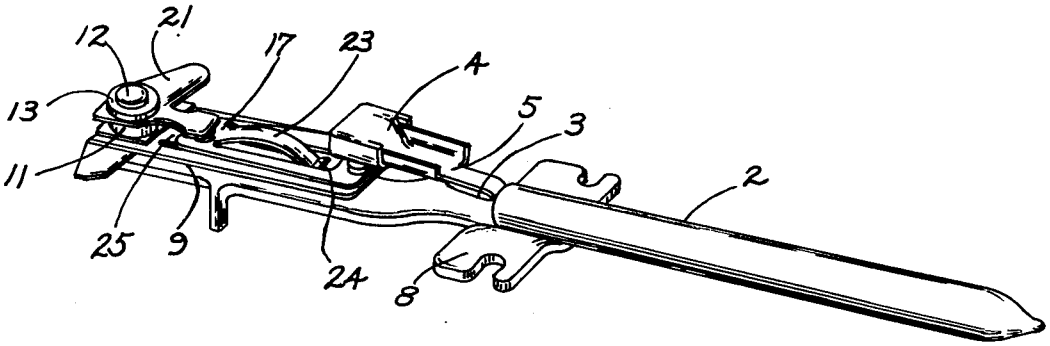
FIG. 2 is a perspective view of the probe and associated switching mechanism.

To form this tongue 25, support blade 9 is itself provided in the nature of a deflectable plate and has a medical longitudinal portion which is severed along two parallel sides and at one end to be free to move somewhat in relation to the support blade 9 without moving the support blade 9 itself. This severed portion of the blade 9 forms the tongue 25. This is shown in FIGS. 1 and 2. However, the tongue 25 could be separately supported from the blade 9 by means of the pin 12 and insulator assembly but in that case the support blade 9 would have to be cut to give the control member 27 access to the tongue 25 to engage and move the tongue independently of the support blade 9 as shown in FIGS. 3, 4 and 5.

When the device is set by adjusting the position of the reaction point 24 as noted, any movement of the free end of the support blade 9 will move that end of the switch blade 17 in relation to the reaction point 24, and as the position of the free end of the switch blade 17 determines where the reaction point 24 is in relation to the plane of switch blade, selected operation of the device at any required temperature is possible by adjusting the position of the reaction point 24 with the control 27.

The tongue can as said, be shaped from the support blade 9 or can be a separate member as shown in FIGS. 3, 4 and 5 as it need not be part of the support blade 9. The purpose of the support blade 9 is to provide a spring mounting for the end of the switch blade 17 to allow this end to move under influence of pressure from the temperature sensitive member (rod 3 and probe 2) while the tongue 25 serves the purpose of allowing the position of the reaction point 24 to be adjusted in relation to the plane of the switch blade 17 so that the spring portion of the switch blade will move the free, contact-carrying end of the switch blade 17 with snap action when the existing balance is upset.

It will be realised that this form of assembly can be used on any type of thermostatic snap switch and has the advantage that a magnified and rapid movement of the movable contact 20 in relation to a fixed contact 14 can be achieved. The assembly first of all permits the reaction point 24 of the stressed switch blade 17 to be moved in relation to the plane in which the switch blade is disposed at the time and this causes rapid and relatively extensive movement of the movable contact although movement at the free end of the blade 9 is only slight.

Obviously to select a different temperature at which the unit will operate it is necessary to position the reaction point by the setting device 27 to a location where the switch blade will pass its axis through the point 24 when the temperature sensitive member (rod 3 and probe 2) moves the end of the support blade 9 under selected temperature effects.

As the reaction point 24 is movable in relation to the frame, its position can be quite widely varied to achieve switching at different temperatures. That is different positions of the end of the temperature sensitive rod 3 can be selected at which the switch blade will overbalance to its new position.

Briefly therefore the invention can be said to comprise a support blade 9 which is fixedly mounted at one end in relation to the mounting of the temperature sensitive member but has its free end in the path of the pressure head 4 so that movement of the pressure head 4 under control of the temperature will move the free end of the support blade 9.

In turn this support blade 9 supports a switch blade 17 which projects preferably parallel to the support blade 9 and towards the support of the fixed end of the blade 9 and carries on it the one contact, the other contact being mounted on a contact support insulated from the support blade 9.

The switch blade is conveniently the normal type of quick action device which comprises a plate in which is a somewhat elongated U-shaped slot which leaves a projecting central strip 23 extending between the fixed end of the switch blade and the contact on the switch blade. By loading this strip member to cause it to bow, it will control the position of the free end of the switch blade in relation to the position of the loaded end of the spring member. The loaded end of the spring member engaged by a tongue which can be moved to position the reaction point of the spring part of the switch blade in relation to the plane of the switch blade.

The usual electrical connections can be made to the contact supporting members and it will be realised that both the shape of the support blade and of the switch blade can be varied but the arrangement must be such that a reaction point on the spring part of the switch blade can be moved to allow temperature adjustment or selection of the temperature at which the overbalance of the switch blade will take place to either open or close the contacts.

We claim:

1. A thermostatic snap switch comprising a support blade having a movable end, a temperature sensitive means mounted to deflect the movable end of the support blade in response to temperature change, a switch blade which has one end secured to the movable end of the support blade for movement with the movable end of the support blade, the switch blade having a movable contact at its opposite end movable between positions in and out of engaged relation with a fixed contact, the switch blade having a tension member portion intermediate the ends of the switch blade, and adjustable reaction point means engaging the tensioning member portion on the switch blade at one side of the plane of the switch blade for holding the movable contact in one of said contact positions, the reaction point means being adjustable in position through the plane of the switch blade to the opposite side of the plane of the switch blade to overbalance the switch blade and move the movable contact to the other of said contact positions with snap action, whereby the reaction point means is adapted to be located so that deflecting of the movable end of the support blade in response to selected temperature change moves the movable contact between said contact positions with snap action.

2. A thermostatic snap switch as claimed in claim 1 wherein the temperature sensitive member comprises a proble and rod mounted for movement relative to each other in response to temperature change, and a pressure head is mounted to be displaced by relative movement of the probe and rod according to the temperature of the probe and rod and in turn engages the movable end of the said support blade for selectively deflecting the movable end of the support blade.

3. A thermostatic snap switch as claimed in claim 1 wherein one end of the support blade is secured to a frame support and the other movable end of the support blade is free to deflect.

4. A thermostatic snap switch as claimed in claim 3 wherein the switch blade is secured at its one end to the free movable end of the support blade and probjects generally back along the length of the support blade, the switch blade has its opposite end free to move the movable contact between said contact positions, the tensioning member portion on the switch blade comprises a spring tongue punched out and separated along its length from the central portion of the switch blade which is secured at one end to the switch blade projecting from the free end of the switch blade towards the end of the switch blade secured to the support blade, and the reaction point means comprises a tongue portion which is punched out and separated along its length from the central portion of the support blade, which is secured at one end to the support blade projecting from said one secured end of the support blade toward the movable end of the support blade, and which is turned up at its opposite end to engage the spring tongue of the switch blade.

5. A thermostatic snap switch which comprises a probe, a member associated with said probe, a free end of which is displaceable by temperature changes, a switch blade secured to a support which carries the said probe and having a free end projecting into the path of movement of the free end of the temperature sensitive member, an overbalancing switch blade secured at its one end to the free end of the support blade and projecting generally back along the support blade, but clear thereof, a tensioning member on the switch blade projecting from its free end towards the end which is secured to the support blade, a tongue supported at one end to form the said support and projecting freely generally in the plane of the support blade and having a free end engaging said free end of said tongue, means to adjust the position of the free end of said tongue through the plane of movement of the overbalancing switch blade whereby to change the overbalancing point of the said switch blade in relation to pressure applied by the temperature sensitive member on the free end of the support blade, a movable switch contact on the free end of said overbalancing switch blade, and a fixed contact insulated from and carried by said support and disposed in the path of the said movable contact.

* * * * *